US006796443B2

(12) United States Patent
Lippman et al.

(10) Patent No.: US 6,796,443 B2
(45) Date of Patent: Sep. 28, 2004

(54) CAROUSEL

(75) Inventors: Ernie Lippman, Elburn, IL (US); Li Cao Li, Naperville, IL (US)

(73) Assignee: Plano Molding Company, Plano, IL (US)

( * ) Notice: Subject to any disclaimer, the term of this patent is extended or adjusted under 35 U.S.C. 154(b) by 0 days.

(21) Appl. No.: 10/282,594

(22) Filed: Oct. 29, 2002

(65) Prior Publication Data

US 2003/0121873 A1 Jul. 3, 2003

Related U.S. Application Data

(60) Provisional application No. 60/350,902, filed on Oct. 29, 2001.

(51) Int. Cl.[7] ..... A47F 5/00
(52) U.S. Cl. ..... 211/131.1; 211/163; 211/194
(58) Field of Search ..... 211/129.1, 131.1, 211/163, 194

(56) References Cited

U.S. PATENT DOCUMENTS 3,227,283 A * 1/1966 Ahlman
3,503,523 A * 3/1970 Hamilton et al. ..... 211/163
4,736,856 A * 4/1988 Alneng et al. ..... 211/131.1
4,953,696 A * 9/1990 Huang et al. ..... 211/163 X
4,964,520 A * 10/1990 Kilmartin ..... 211/163 X
5,799,787 A * 9/1998 Talbot
6,223,921 B1 * 5/2001 Huang

* cited by examiner

*Primary Examiner*—Robert W. Gibson, Jr.
(74) *Attorney, Agent, or Firm*—Vedder, Price, Kaufman & Kammholz PC

(57) ABSTRACT

A carousel of the present invention includes a base tray including a plurality of receptacles, defined by an outer wall and at least one inner wall, and at least one mounting recess formed in the base tray. At least one tray assembly is operatively connected to the base tray for relative movement thereto. Each tray assembly includes a tray portion operatively connected to a sleeve. The tray portion includes a cylinder, a first exterior wall extending from the cylinder and a second exterior wall extending from the first exterior wall. A plurality of first receptacles are defined in the tray portion by the first exterior wall, the cylinder and at least one first interior wall. A plurality of second receptacles are defined in the tray portion by the second exterior wall, the first exterior wall and at least one second interior wall. The sleeve engages the cylinder of the tray portion in order to connect each tray portion to the base tray.

12 Claims, 7 Drawing Sheets

CAROUSEL

PRIOR APPLICATION

This application claims the benefit of U.S. Provisional application No. 60/350,902, filed Oct. 29, 2001.

BACKGROUND OF THE INVENTION

The present invention relates generally to a device for holding makeup and accessories, and more particularly, to a multi-level turntable-style receptacle assembly for holding makeup and accessories where each level is moveable relative to the adjacent levels.

Organization and accessibility to much of one's makeup and accessories is important to women and young ladies. A device which stores nearly all of the makeup and accessories is highly desirable. Prior art designs fail to provide such a device in a simple design. Further, the ability to easily remove one component of the system for use in a remote location is not provided by the prior art.

Therefore, there is a significant demand for an inexpensive device for storing and holding makeup and accessories which overcomes the disadvantages of the prior art and provides the advantages of low cost, ease of use, separatability for remote use and easy access in a compact design.

BRIEF DESCRIPTION OF THE DRAWINGS

The features of the present invention will be more readily understood from the following detailed description of examples of embodiments thereof when read in conjunction with the accompany drawings, of which.

DETAILED DESCRIPTION OF A PREFERRED EMBODIMENT OF THE INVENTION

In one aspect of the present invention, a carousel includes a base tray including a plurality of receptacles, defined by an outer wall and at least one inner wall and at least mounting recess form in the base tray. At least one tray assembly is operatively connected to the base tray for relative movement thereto. Each tray assembly includes a tray portion operatively connected to a sleeve. The tray portion includes a cylinder, a first exterior wall extending from the cylinder and a second exterior wall extending from the first exterior wall. A plurality of first receptacles are defined in the tray portion by the first exterior wall, the cylinder and at least one first interior wall. A plurality of second receptacles are defined in the tray portion by the second exterior wall, the first exterior wall and at least one second interior wall. The sleeve engages the cylinder of the tray portion in order to connect each at least one tray assembly to the base tray.

In another aspect of the present invention, a carousel includes a base operatively connected to a base tray for relative movement. The base tray includes a plurality of receptacles and a mounting recess. A first tray assembly is operatively connected to the base tray and the first tray assembly includes a first tray portion operatively connected to a first sleeve. The first tray portion has a cylinder, a plurality of receptacles offset to the cylinder and an overall height. The plurality of receptacles are designed as a first set each having openings disposed at a first height and second set having openings disposed at a second height. The first sleeve engages the cylinder and the mounting recess in order to connect the first tray portion to the base tray such that the first tray portion is moveable relative to the base tray and is removable from the base tray only when the first tubular sleeve is disconnected from the recess and the first cylinder.

At least one second tray assembly operatively connected to the first tray assembly. Each at least one second tray assembly includes a second tray portion operatively connected to a second sleeve. The second tray portion having a second cylinder, a plurality of receptacles offset to the cylinder and a second overall height; said plurality of receptacles defined as a first set each have openings disposed at a first height and second set each have openings disposed at a second height. The second sleeve engages the cylinder and the first sleeve in order to connect the second tray portion to the first tray portion such that the second tray portion is moveable relative to the first tray portion and the base tray and is removable from the first tray assembly only when the second sleeve is disconnected from the first sleeve and the second cylinder. The base, base tray, the first tray assembly and each at least one second tray assembly are oriented about a common axis.

Figure 1:
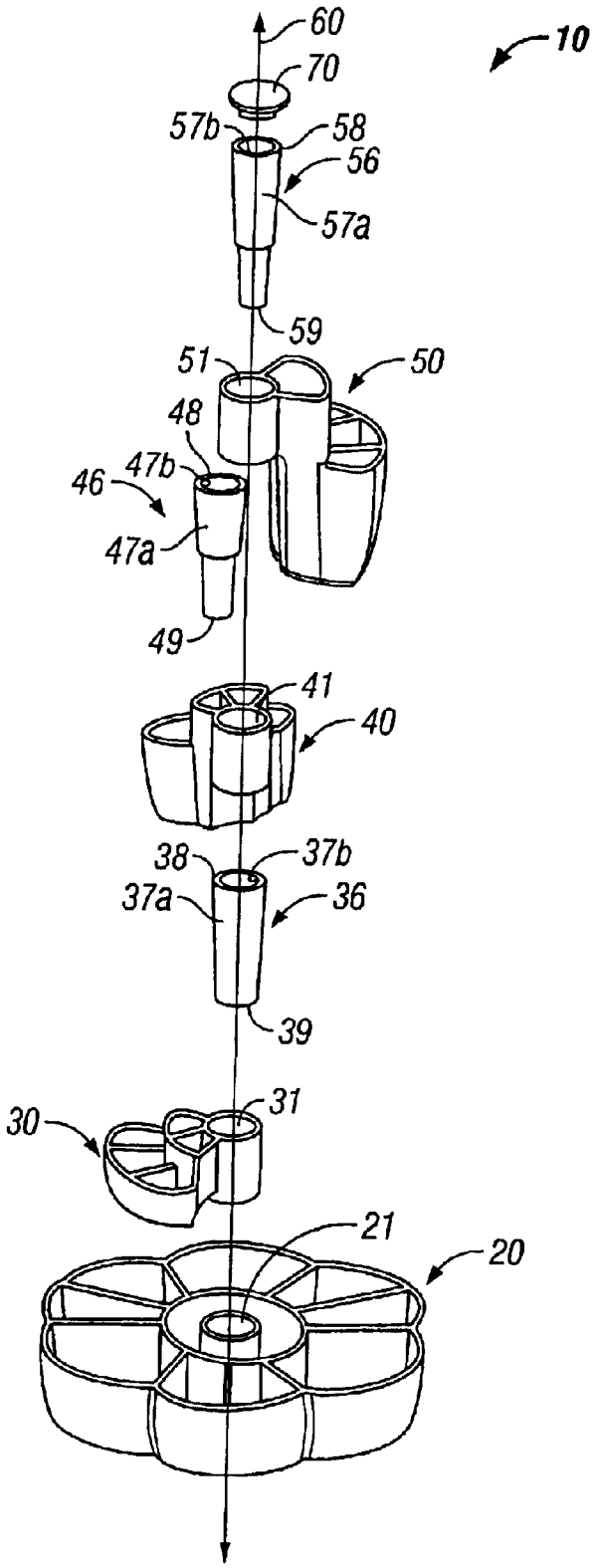
FIG. 1 is an exploded view illustrating one example of the carousel in accordance with one embodiment of the invention.

FIG. 1 is an exploded view of a carousel 10 in accordance with one embodiment of the present invention. The carousel 10 includes a base tray 20, a first tray portion 30, a second tray portion 40, and a third tray portion 50. A first sleeve 36, second sleeve 46 and third sleeve 56 respectively position the second 30, third 40 and fourth 50 tray portions about an axis 60 extending through the center of the base tray 20 and perpendicular thereto, such that the second 30, third 40 and fourth 50 tray portions are rotatable relative to the base tray 20. The tray portions 30, 40, 50 and sleeves 36, 46, 56 cooperatively define $2^{nd}$ form individual tray assemblies, when first tray portion 30 and first sleeve 36 define the first tray assembly, the second tray portion 40 and second sleeve 46 define the second tray assembly and the third party portion 50 and third sleeve 56 define the third tray assembly. Additional tray assemblies may be added as desired.

The carousel 10 further includes a cap 70 which engages the third sleeve 56 to close the tube openings. It will be recognized that the carousel 10 may be formed from any suitable material, for example, plastic, ABS, nylon or any other suitable material.

Figure 12:
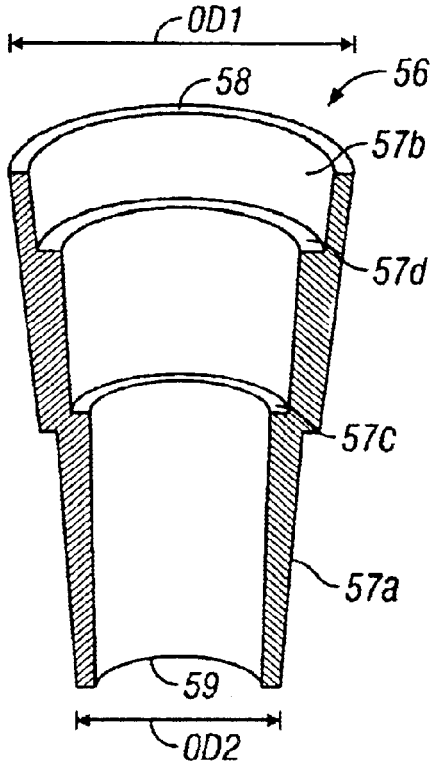
FIG. 12 is a cross-sectional view of the third sleeve of FIG. 1.
Figure 13:
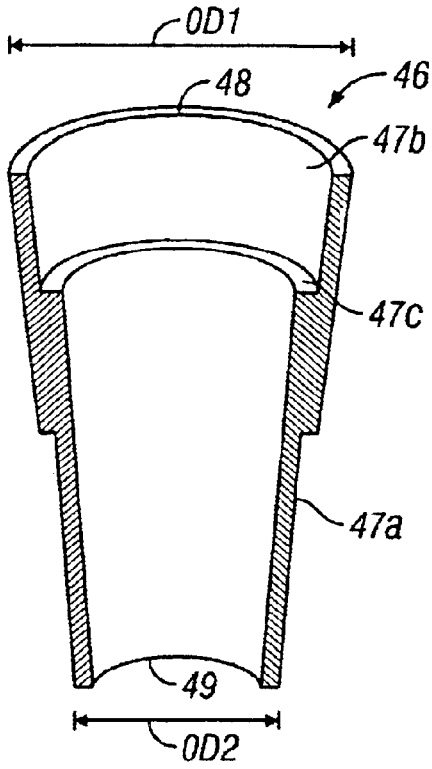
FIG. 13 is a cross-sectional view of the second sleeve of FIG. 1.
Figure 14:
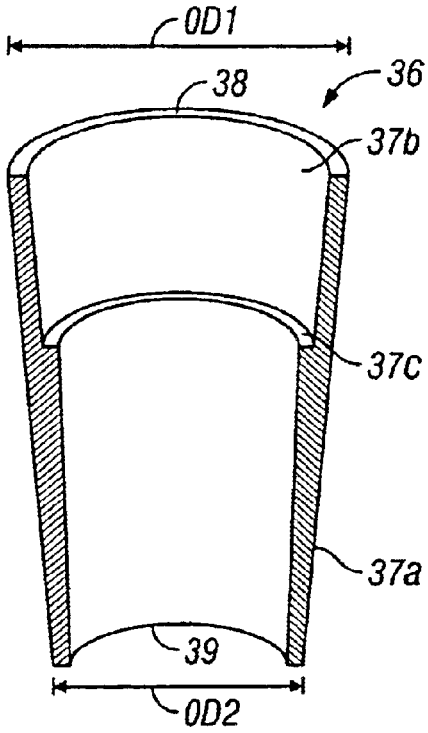
FIG. 14 is a cross-sectional view of the first sleeve of FIG. 1.

The first 36, second 46 and third 56 sleeves each have similar structural and functional configurations. As shown in FIGS. 12–14, the sleeves 36, 46, 56 include a substantially cylindrical wall having an outer surface 37*a*, 47*a*, 57*a*, an inner surface 37*b*, 47*b*, 57*b*, a first end 38, 48, 58 and a second end 39, 49, 59. The outer surfaces 37*a*, 47*a*, 57*a* have a generally tapered configuration such that the first ends 38, 48, 58 have an outer diameter OD1 which is greater than the outer diameter OD2 of the second ends 39, 49, 59. The inner surfaces 37*b*, 47*b*, 57*b* have an annular step 37*c*, 47*c*, 57*c* at a predetermined position along the respective sleeves length to engage an associated second end as will be discussed below such that depth of engagement is positively controlled. The third sleeve 56 has two an additional annular step 57*d* which engages the cap and provides a positive stop therefor.

To assemble for use, the first sleeve 36 is inserted through a bore 31 defined by a cylinder 32 of the first tray portion 30 until the taper of the wall outer surface 37*a* prevents further movement such that a portion of the first sleeve 36 including the second end 39 extends out of the cylinder 32 and is positioned to be received within a mounting recess 21 formed in the base tray 20. The mounting recess 21 may be disposed about the axis 60 in this embodiment, or any other suitable location. For example, multiple mounting recesses may be provided for additional storage or optional mounting. Preferably, the second end 39 is disposed in the mounting recess 21 adjacent the bottom (see FIGS. 2 and 3), such that the bottom functions as a stop to set the desired insertion depth of the first sleeve 36. It will be recognized that any other suitable positioning structure may be used, for example, a stepped inner wall, tapered configuration or any other suitable structure.

The second sleeve 46 is inserted into a bore 41 defined by a cylinder 42 formed on the second tray portion 40 until the taper of the outer surface 47*a* prevents further insertion movement of the second sleeve 46. A portion of the second sleeve 46 including the second end 49 extends beyond the bore 41 of the second tray portion 40 to engage the inner surface 37*b* adjacent the first end 38 of the first sleeve 36. The diameter of the inner surface 37*b* is larger than the diameter of the outer surface 47*a* in order to receive the second end 49 within the first end 38. Preferably, the second end 49 contacts the step (as shown in FIG. 14) on the inner surface 37*b* to set the desired insertion depth of the second sleeve 46. It will be recognized that any other suitable positioning structure may be used, for example, a tapered configuration or any other suitable structure.

The third sleeve 56 is inserted through a bore 51 defined by a cylinder 52 formed on the third tray portion 50 until the taper of the outer surface 57*a* prevents further insertion movement of the third sleeve 56. A portion of the third sleeve 56 including the second end 59 extends beyond the bore 51 of the third tray portion 50 to engage the second sleeve 46. The diameter of the inner surface 47*b* is larger than the diameter of the outer surface 57*a* in order to receive the second end 59 within the first end 48. Preferably, the second end 59 contacts the step (as shown in FIG. 13) on the inner surface 47*b* to set the desired insertion depth of the third sleeve 56. It will be recognized that any other suitable positioning structure may be used, for example, a tapered configuration or any other suitable structure.

Figure 2:
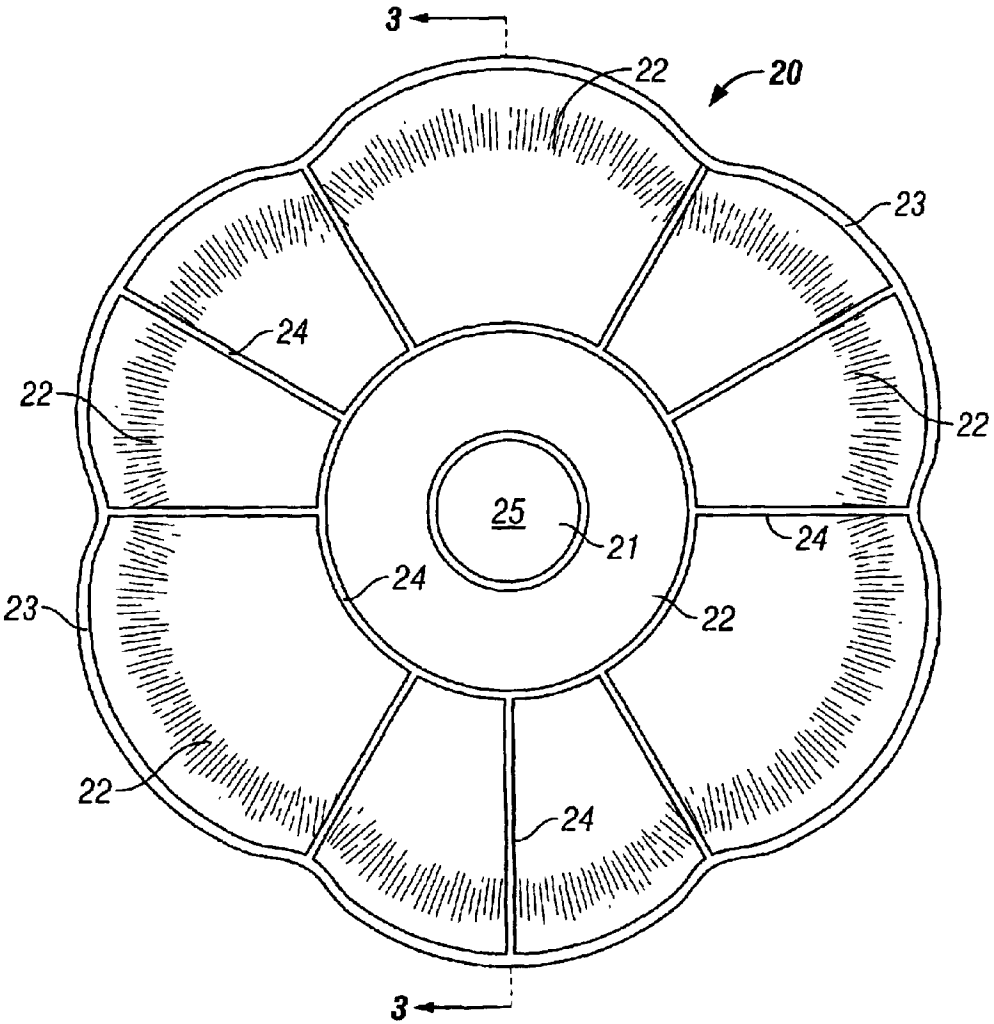
FIG. 2 is a top plan view of the base tray of the carousel of FIG. 1.

FIG. 2 is a top plan view of the base tray 20. The mounting recess 21 is centrally disposed to function as discussed above. A plurality of receptacles 22 are defined in the first tray portion 20 disposed about the mounting recess 21. An outer wall 23 and an inner wall 24 define the receptacles 22. The receptacles 22 are further defined by at least one inner wall 24. It will be recognized that the outer wall 23 and divider walls 24 may be formed in any suitable configuration or manner. For example, the outer wall 23 and divider walls 24 may be curvilinear, straight or any other suitable configuration. The outer wall 23 further defines the bottom 25 of the mounting recess.

Figure 3:
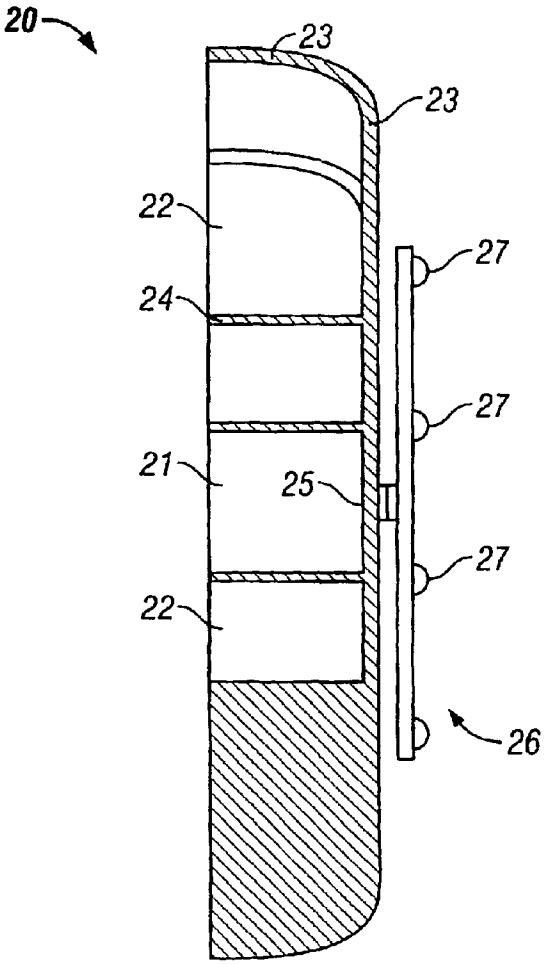
FIG. 3 is a cross-sectional view of the base tray of FIG. 2 taken along line A—A in FIG. 2.

FIG. 3 is a cross-sectional view of the base tray 20 of FIG. 2 taken along line A—A. The outer wall 23 defines the bottom and side boundaries of the receptacles 22 and the bottom of the mounting recess 21. The inner walls 24 extend upwardly from the bottom of the base tray 20. In this embodiment one inner wall is circular and centrally disposed and other inner walls radiate therefrom. The mounting recess 21 is centrally disposed within the base tray 20. A base 26 is movably connected to the base tray 20 such that the base tray 20 is rotatable relative to the base 26. A plurality of feet 27 on the base 26 contact the surface upon which the carousel 10 is disposed.

Figure 4:
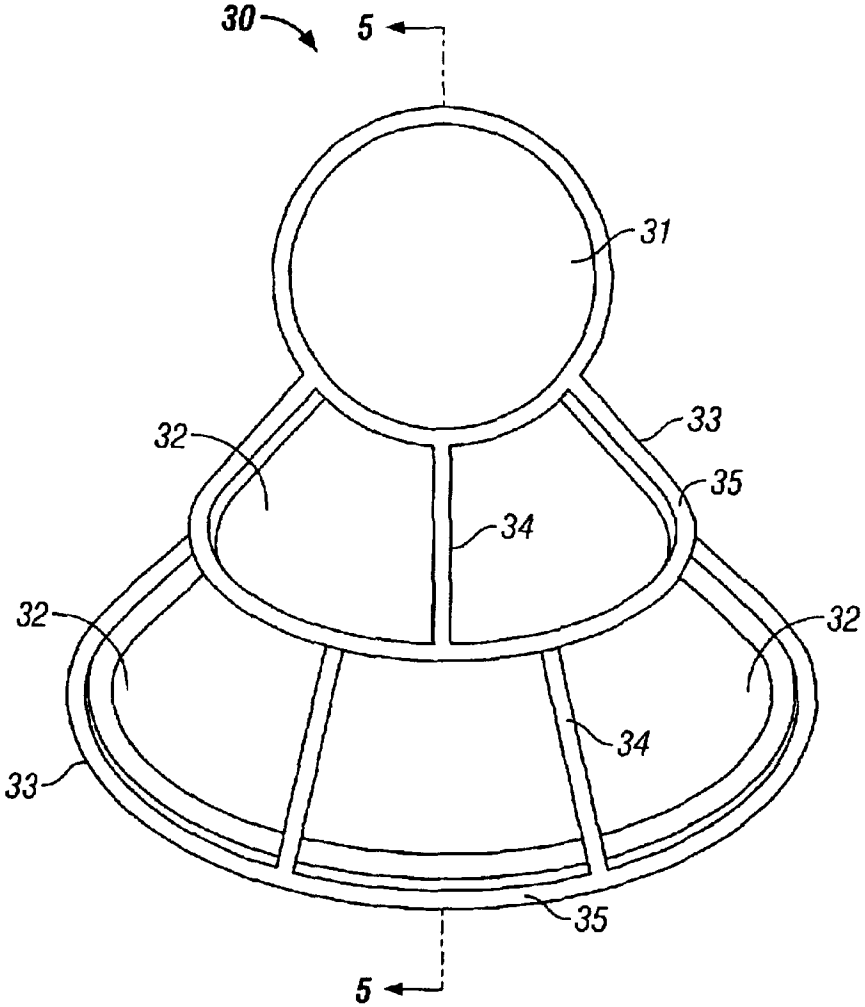
FIG. 4 is a top plan view of the first tray portion of the carousel of FIG. 1.

FIG. 4 is a top plan view of the first tray portion 30. The cylinder 36 defining the bore 31 is offset with regard to a plurality of receptacles 32*a*, 32*b* defined by an outer wall. The outer wall includes a first exterior wall 33*a* extending from the cylinder 36 and a second exterior wall 33*b* extending from the first exterior wall 33*a*. A plurality of divider walls subdivide the receptacles 32*a*, 32*b*. A plurality of first receptacles 32*a* are defined in the first tray portion by the first exterior wall 33*a*, the cylinder 36 and at least one first interior wall 34*a*. A plurality of second receptacles 32*b* are defined in the first tray portion by the second exterior wall 33*b*, first exterior wall 33*a* and at least one second interior wall 34*b*. A top edge 35 of the outer walls 33*a*, 33*b* is disposed in different planes in this embodiment. However, it will be recognized that the top edge may be formed in any suitable configuration. For example, the top edge may be disposed in single, dual or triple planes or any other suitable configuration.

Figure 5:
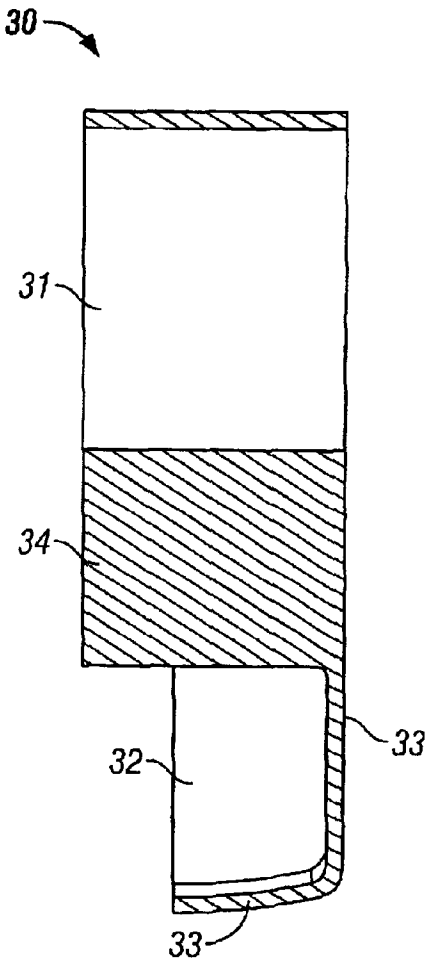
FIG. 5 is a cross-sectional view of the first tray portion of FIG. 4 taken along line B—B in FIG. 4.

FIG. 5 is a cross-sectional view of the first tray portion 30 taken along line B–B in FIG. 4. The outer walls 33*a*, 33*b* define the side and bottom of the receptacles 32*a*, 32*b*. The first interior wall 34*a* extends upwardly from the bottom portion of the outer wall 33*a*. The bore 31 is defined by a cylinder 36 formed offset with regard to the receptacles 32*a*, 32*b*.

Figure 6:
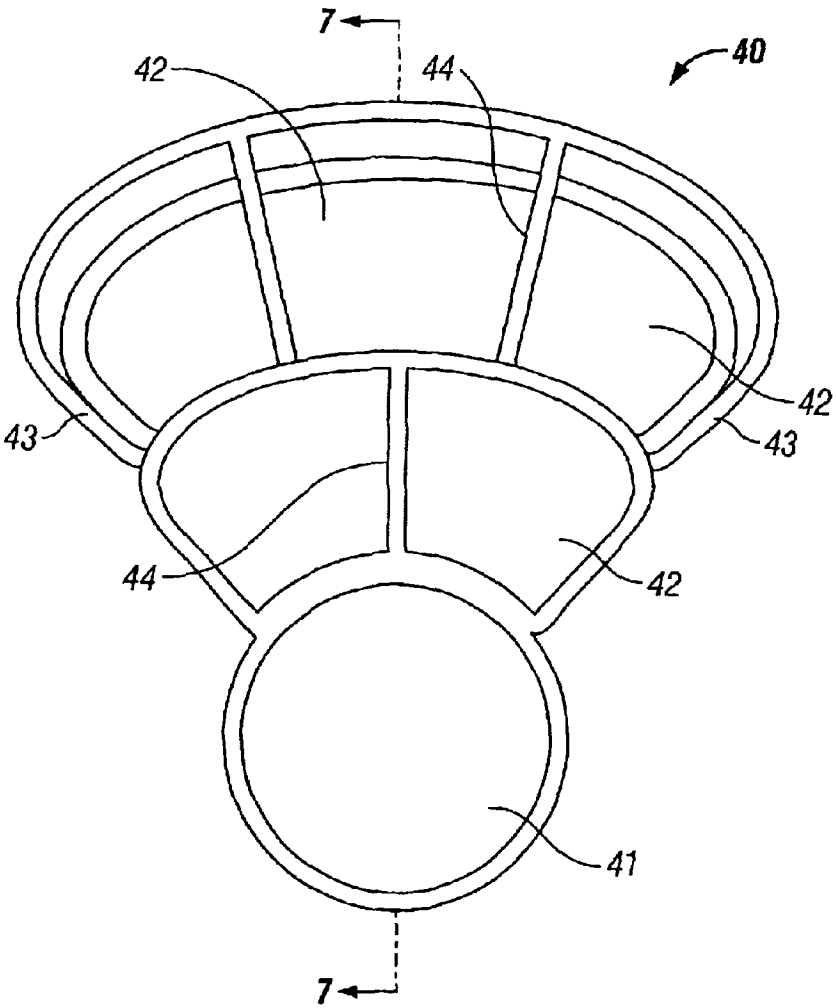
FIG. 6 is a top plan view of the second tray portion of the carousel of FIG. 1.

FIG. 6 is a top plan view of the second tray portion 40. A cylinder 46 defining the bore 41 is offset with regard to a plurality of receptacles 42*a*, 42*b* defined by an outer wall. The outer wall includes a first exterior wall 43*a* extending from the cylinder 46 and a second exterior wall 43*b* extending from the first exterior wall 43*a*. A plurality of divider walls subdivide the receptacles 42*a*, 42*b*. A plurality of first receptacles 42*a* are defined in the second tray portion by the first exterior wall 43*a*, the cylinder 46 and at least one first interior wall 44*a*. A plurality of second receptacles 42*b* are defined in the first tray portion by the second exterior wall 43*b*, first exterior wall 43*a* and at least one second interior wall 44*b*. A top edge 45 of the outer walls 43*a*, 43*b* is disposed in different planes in this embodiment. However, it will be recognized that the top edge may be formed in any suitable configuration. For example, the top edge may be disposed in single, dual or triple planes or any other suitable configuration.

Figure 7:
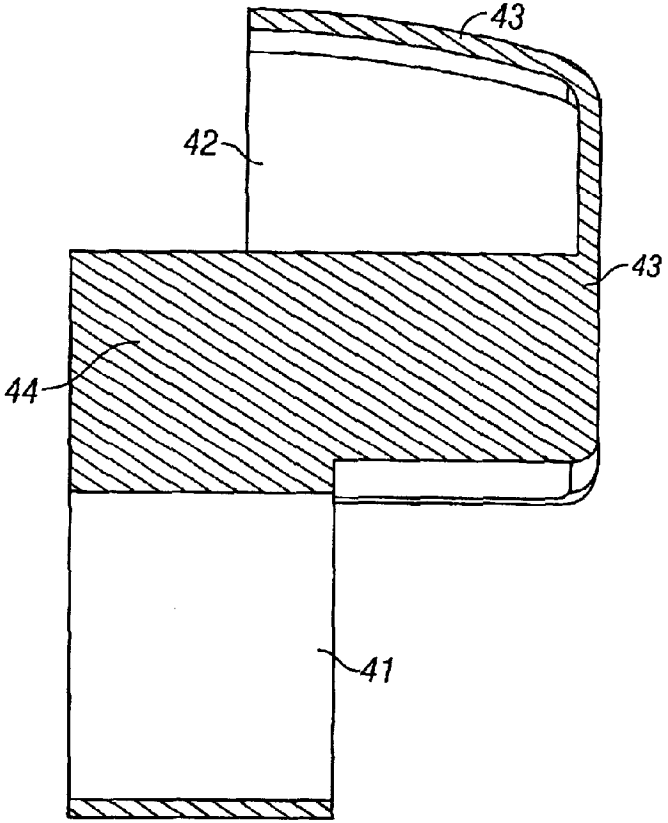
FIG. 7 is a cross-sectional view of the second tray portion of FIG. 6 taken along line C—C in FIG. 6

FIG. 7 is a cross-sectional view of the second tray portion 40 taken along line C–C in FIG. 6. The outer walls 43*a*, 43*b* define the side and bottom of the receptacles 42*a*, 42*b*. The first interior wall 44*a* extends upwardly from the bottom portion of the outer wall 43*a*. The bore 41 is defined by a cylinder 46 formed offset with regard to the receptacles 42*a*, 42*b*.

Figure 8:
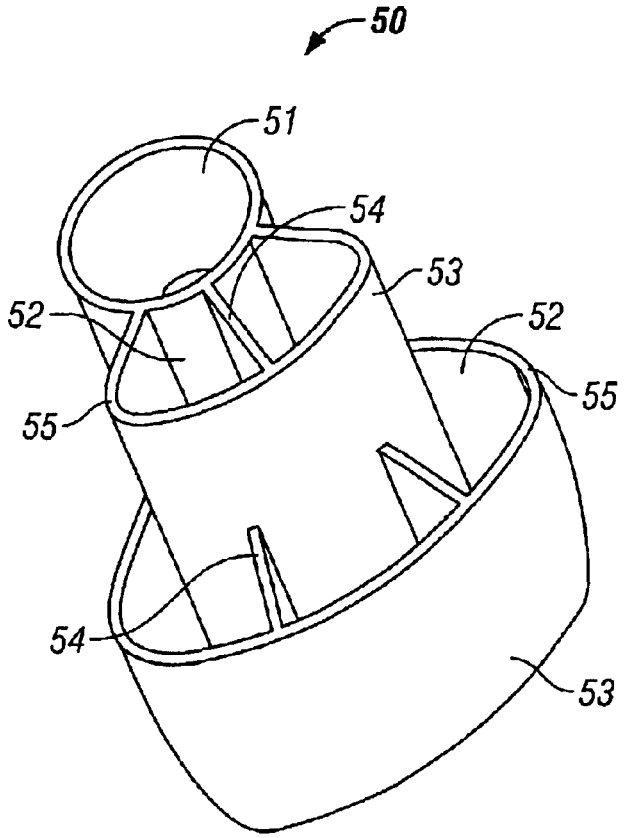
FIG. 8 is a perspective view of the third tray portion of the carousel of FIG. 1.

FIG. 8 is a perspective view of the third tray portion 50. A cylinder 56 defining the bore 51 is offset with regard to a plurality of receptacles 52*a*, 52*b* defined by an outer wall. The outer wall includes a first exterior wall 53*a* extending from the cylinder 56 and a second exterior wall 53*b* extending from the first exterior wall 53*a*. A plurality of divider walls subdivide the receptacles 52*a*, 52*b*. A plurality of first receptacles 52*a* are defined in the third tray portion by the first exterior wall 53*a*, the cylinder 56 and at least one first interior wall 54*a*. A plurality of second receptacles 52*b* are defined in the third tray portion by the second exterior wall 53*b*, first exterior wall 53*a* and at least one second interior wall 54*b*. A top edge 55 of the outer walls 53*a*, 53*b* is disposed in different planes in this embodiment. It will be recognized that the top edge 55 may be disposed in any suitable configuration. For example, the top edge may be disposed in single, dual or triple planes or any other suitable configuration.

Figure 9:
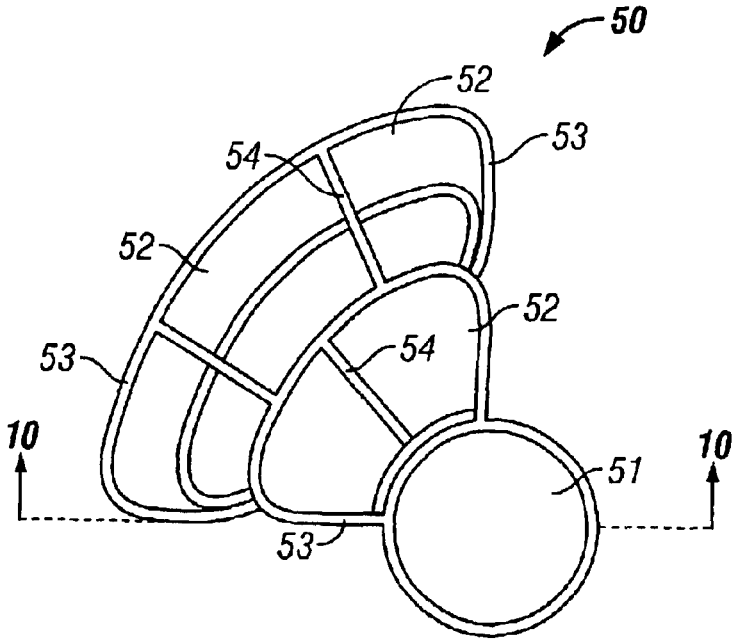
FIG. 9 is a top plan view of the third tray portion of FIG. 8.

FIG. 9 is a top plan view of the first tray portion 50. A cylinder 56 defining the bore 51 is offset with regard to a plurality of receptacles 52*a*, 52*b*.

Figure 10:
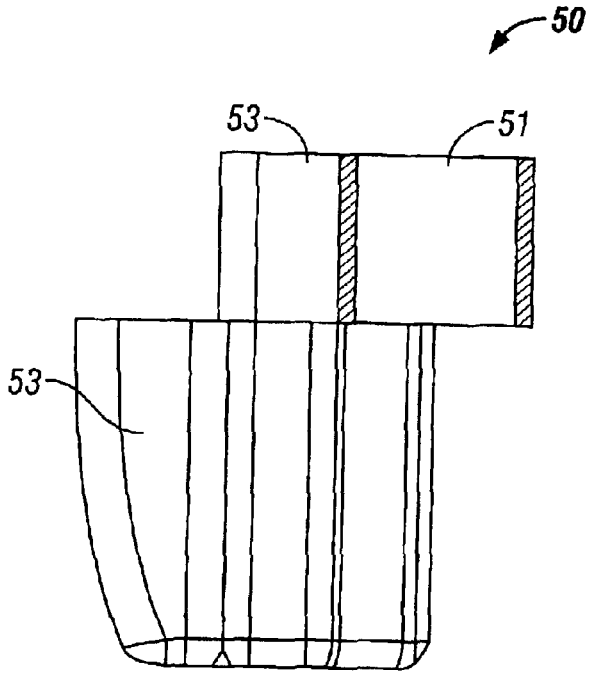
FIG. 10 is a cross-sectional view of the third tray portion of FIG. 9 taken along line D—D in FIG. 9.

FIG. 10 is a cross-sectional view of the first tray portion 50 taken along line D–D in FIG. 9. The outer walls 53*a*, 53*b* define the side and bottom of the receptacles 52*a*, 52*b*. The first and second interior walls 54*a*, 54*b* extend upwardly from the bottom portion of the outer walls 53*a*, 53*b*. The bore 51 is formed offset with regard to the receptacles 52.

Figure 11:
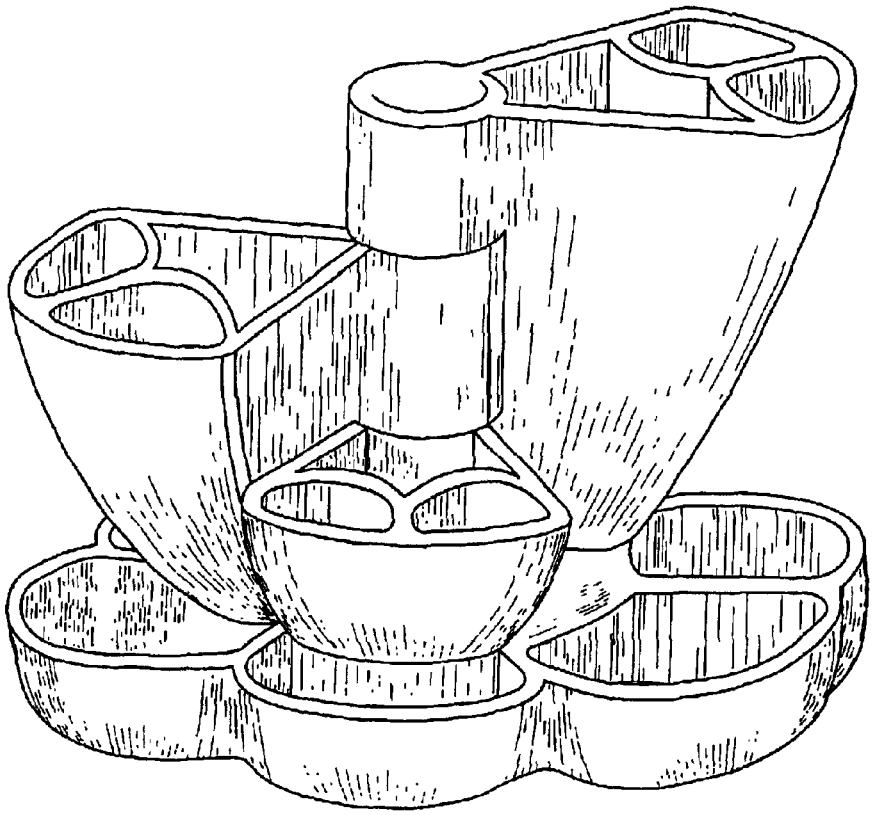
FIG. 11 is a perspective view of the carousel in accordance with an alternative embodiment of the present invention.

FIG. 11 shows an alternative embodiment of the present invention wherein the top edges 35, 45, 55 of each second, third and third tray portions 30, 40, 50 are disposed in a single plane. It will be recognized that the structure and function of the remainder of each respective tray portion is the same as described above.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A carousel comprising:

a base tray including a plurality of receptacles, defined by an outer wall and at least one inner wall, and at least one mounting recess formed in the base tray:

at least one tray assembly operatively connected to the base tray for relative movement thereto;

each tray assembly including a tray portion operatively connected to a sleeve;

the tray portion including a cylinder, a first exterior wall extending from the cylinder and a second exterior wall extending from the first exterior wall;

a plurality of first receptacles defined in the tray portion by the first exterior wall, the cylinder and at least one first interior wall, and a plurality of second receptacles defined in the tray portion by the second exterior wall, the first exterior wall and at least one second interior wall wherein the first exterior wall; has a first top edge and the second exterior wall has a second top edge, and the first top edge is disposed vertically offset from the second top edge; and the sleeve engaging the cylinder of the tray portion in order to connect each at least one tray assembly to the base tray.

2. The carousel as recited in claim 1, wherein the sleeve includes a first end having a first outer diameter, and a second end having a second outer diameter such that the first outer diameter is less than the second outer diameter and an outer surface of the sleeve has a taper from the second end to the first end.

3. The carousel as recited in claim 2, wherein the cylinder has an inner diameter which is greater than the first outer diameter and less than the second outer diameter so that the tray portion is secured to the base tray.

4. The carousel as recited in claim 2, wherein each at least one mounting recess includes an outer end having a first inner diameter and an inner end having a second inner diameter such that the first inner diameter is larger than the second inner diameter and an inner surface of each at least one mounting recess has a taper from the first end to the second end.

5. The carousel as recited in claim 4, wherein the sleeve first outer diameter is greater than each at least one mounting recess second inner diameter so that the tubular sleeve is secured to the base tray.

6. The carousel as recited in claim 1, wherein said at least one tray assembly includes a plurality of tray assemblies which are stackable.

7. The carousel as recited in claim 6, wherein each sleeve has a shoulder formed in an inner surface in order to position stacked tray assemblies.

8. A carousel comprising:

a base operatively connected to a base tray for relative movement;

the base tray including a plurality of receptacles and a mounting recess;

a first tray assembly operatively connected to the base tray; said first tray assembly including a first tray portion operatively connected to a first sleeve;

the first tray portion having a cylinder, a plurality of receptacles offset to the cylinder and an overall height; said plurality of receptacles defined as a first set each having openings disposed at a first height and second set each having openings disposed at a second height;

the first sleeve engaging the cylinder and the mounting recess in order to connect the first tray portion to the base tray such that the first tray portion is moveable relative to the base tray and is removable from the base tray only when the first tubular sleeve is disconnected from the recess and the first cylinder;

at least one second tray assembly operatively connected to the first tray assembly; each at least one second tray assembly including a second tray portion operatively connected to a second sleeve;

the second tray portion having a second cylinder, a plurality of receptacles offset to the cylinder and a second overall height; said plurality of receptacles defined as a first set each having openings disposed at a first height and second set each having openings disposed at a second height;

the second sleeve engaging the cylinder and the first sleeve in order to connect the second tray portion to the first tray portion such that the second tray portion is moveable relative to the first tray portion and the base tray and is removable from the first tray assembly only when the second sleeve is disconnected from the first sleeve and the second cylinder; and wherein the base, the base tray, the first tray assembly and each at least one second tray assembly are oriented about a common axis.

9. The carousel as recited in claim 8, wherein the first height of the first set of first tray receptacles is the same as the second height of the second set of first tray receptacles.

10. The carousel as recited in claim 8, wherein the first height of each first set of second tray receptacles is the same as the second height of each second set of second tray receptacles.

11. The carousel as recited in claim 8, wherein the first and second sleeves each have a taper from a second end to a first end such that they are stackable.

12. The carousel as recited in claim 8, wherein the first sleeve has a shoulder formed on an inner surface for engaging a first end of one of the at least one second tubular sleeves.

* * * * *